US010814159B2

(12) United States Patent
Hockridge et al.

(10) Patent No.: US 10,814,159 B2
(45) Date of Patent: Oct. 27, 2020

(54) FLIP AND GRIP HANDLE SYSTEM FOR LATERAL PULLDOWN EXERCISE MACHINE

(71) Applicant: HOIST FITNESS SYSTEMS, INC., Poway, CA (US)

(72) Inventors: Bruce Hockridge, San Diego, CA (US); Billy Kim, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 0 days.

(21) Appl. No.: 16/292,735

(22) Filed: Mar. 5, 2019

(65) Prior Publication Data

US 2019/0282851 A1 Sep. 19, 2019

Related U.S. Application Data

(60) Provisional application No. 62/644,726, filed on Mar. 19, 2018.

(51) Int. Cl.
*A63B 21/00* (2006.01)
*A63B 21/062* (2006.01)

(52) U.S. Cl.
CPC .... *A63B 21/4035* (2015.10); *A63B 21/00181* (2013.01); *A63B 21/0628* (2015.10); *A63B 2225/09* (2013.01); *A63B 2225/10* (2013.01)

(58) Field of Classification Search
CPC ... A63B 21/062; A63B 21/1469; A63B 21/00; A63B 21/00047; A63B 21/0023; A63B 21/00058; A63B 21/06; A63B 21/0005; A63B 21/00054; A63B 21/00061; A63B 21/00065; A63B 21/00069; A63B 21/00072; A63B 21/00178; A63B 21/00181; A63B 21/00185; A63B 23/1227; A63B 23/04; A63B 23/12; A63B 23/1209; A63B 23/1218; A63B 23/1245; A63B 23/1263; A63B 23/1272; A63B 23/1281; A63B 2225/10; A63B 22/0005; A63B 21/4039; A63B 21/4033; A63B 2225/09;

(Continued)

(56) References Cited

U.S. PATENT DOCUMENTS 5,580,341 A 12/1996 Simonson
5,597,375 A * 1/1997 Simonson ..... A63B 23/1254 482/100

(Continued)

OTHER PUBLICATIONS

International Searching Authority, International Search Report and Written Opinion for corresponding International Application No. PCT/US2019/020678, dated May 8, 2019, 7 pages.

*Primary Examiner* — Loan B Jimenez
*Assistant Examiner* — Thao N Do
(74) *Attorney, Agent, or Firm* — Gordon Rees Scully Mansukhani LLP; David R. Heckadon

(57) ABSTRACT

A gripping assembly for a lateral pulldown exercise machine, having: a swivel link connected to a center mount, wherein the swivel link is adapted to be pivotally connected to a pulldown arm of a lateral pulldown exercise machine; an outwardly extending arm connected to the center mount for performing wide-angle grips; an inwardly extending arm connected to the center mount, wherein the inwardly extending arm is rotatable between a forwardly angled position and a backwardly pointing position; and a climb hold attached to the center mount.

5 Claims, 10 Drawing Sheets

(58) Field of Classification Search
CPC ..... A63B 2225/093; A63B 17/00; A63B 2244/09; A63B 21/4043; A63B 21/0442; A63B 21/078; A63B 21/068; A63B 21/22; A63B 21/0608; A63B 21/16; A63B 69/0057; A63B 22/1218
USPC ..... 482/100, 94, 96
See application file for complete search history.

(56) References Cited

U.S. PATENT DOCUMENTS

| | | | | |
|---|---|---|---|---|
| 6,071,216 | A * | 6/2000 | Giannelli | A63B 21/159 482/100 |
| 6,394,937 | B1 * | 5/2002 | Voris | A63B 21/155 482/100 |
| 6,689,023 | B2 * | 2/2004 | Baumler | A63B 23/03525 482/100 |
| 7,322,906 | B2 * | 1/2008 | Webber | A63B 21/06 482/100 |
| 7,361,125 | B2 * | 4/2008 | Webber | A63B 23/03525 482/130 |
| 7,794,371 | B2 * | 9/2010 | Webber | A63B 23/1209 482/95 |
| 8,864,635 | B1 * | 10/2014 | Atwood | A63B 23/03525 482/100 |
| 9,017,238 | B2 * | 4/2015 | Meredith | A63B 21/062 482/142 |
| 9,604,086 | B2 | 3/2017 | Meredith et al. | |
| 9,943,721 | B2 | 4/2018 | Hockridge | |
| 10,532,244 | B2 | 1/2020 | Hockridge | |
| 2002/0052268 | A1 | 5/2002 | Morcillo-Quintero et al. | |
| 2002/0103058 | A1 * | 8/2002 | Webber | A63B 23/1209 482/104 |
| 2003/0022767 | A1 * | 1/2003 | Webber | A63B 21/4035 482/94 |
| 2004/0029688 | A1 * | 2/2004 | Webber | A63B 21/159 482/142 |
| 2006/0035764 | A1 * | 2/2006 | Webber | A63B 23/1263 482/94 |
| 2006/0189462 | A1 * | 8/2006 | Pearson | A63B 21/045 482/142 |
| 2006/0264304 | A1 * | 11/2006 | Habing | A63B 23/1254 482/98 |
| 2007/0213184 | A1 * | 9/2007 | Habing | A63B 23/0211 482/97 |
| 2007/0232464 | A1 * | 10/2007 | Chu | A63B 21/00181 482/96 |
| 2009/0170668 | A1 * | 7/2009 | Giannelli | A63B 23/1245 482/94 |
| 2010/0009818 | A1 | 1/2010 | Simonson et al. | |
| 2010/0323852 | A1 * | 12/2010 | Locsin | A63B 21/4017 482/96 |
| 2011/0092343 | A1 * | 4/2011 | Habing | A63B 23/1254 482/94 |
| 2011/0251028 | A1 * | 10/2011 | Bono | A63B 23/1218 482/93 |
| 2013/0109542 | A1 * | 5/2013 | Hockridge | A63B 23/1272 482/94 |
| 2017/0136287 | A1 * | 5/2017 | Ucgun | F16B 7/044 |
| 2017/0182347 | A1 | 6/2017 | Meredith et al. | |
| 2018/0345063 | A1 | 12/2018 | Meredith | |
| 2019/0054337 | A1 * | 2/2019 | Meredith | A63B 21/4047 |
| 2019/0247700 | A1 | 8/2019 | Webber et al. | |
| 2019/0282848 | A1 | 9/2019 | Meredith | |
| 2019/0336808 | A1 | 11/2019 | Meredith | |
| 2019/0358495 | A1 | 11/2019 | Hockridge et al. | |
| 2020/0003250 | A1 | 1/2020 | Hockridge | |
| 2020/0086171 | A1 | 3/2020 | Meredith et al. | |
| 2020/0121979 | A1 | 4/2020 | Hockridge | |

* cited by examiner

FLIP AND GRIP HANDLE SYSTEM FOR LATERAL PULLDOWN EXERCISE MACHINE

RELATED APPLICATION

The present application claims priority to U.S. Provisional Application 62/644,726 entitled Flip and Dip Handle System for Lateral Pulldown Exercise Machine, filed Mar. 19, 2018, the entire disclosure of which is incorporated herein by reference in its entirety for all purposes.

TECHNICAL FIELD

The present invention relates to lateral pulldown exercise machines.

BACKGROUND OF THE INVENTION

U.S. Pat. Nos. 9,017,238 and 9,604,086 assigned to Hoist Fitness Systems show details of a handle assembly that is fixedly mounted onto the frames of various exercise machines. The handle assembly is used to provide various ways in which the user can grasp onto the exercise machine when doing chin-ups, pull-ups, wide-angle grips or even climbing mount grips. Unfortunately, in these existing systems, the handle assembly is fixed in position on the handlebars and does not move.

It would instead be desirable to provide a versatile moveable gripping handle assembly that can also be used with a "lateral pulldown" machine (understood herein to be an exercise machine in which the user remains in a sitting position and pulls down on a pair of left and right handles to exercise their upper back). Lateral pulldown machines specifically work the user's upper back muscles, especially focusing on the latissimus dorsi. During a standard lateral pulldown, the seated user reaches up and grabs left and right handle grips. Both of the user's elbows and shoulders then bend as the user pulls downwardly on a pair of rotating arms or pulleys connected to lift a weight stack, thereby exercising their upper back muscles. Providing a versatile moveable gripping handle assembly on such a lateral pulldown machine would advantageously give the user a number of different gripping options, and exercise benefits.

Unfortunately, simply mounting the existing handle assembly (from the '238 or '086 patents mentioned above) onto the ends of the rotating pull down arms of a standard lateral pulldown machine would not be ideal. Specifically, it would not address the issue of the ends of the various gripping arms rotating somewhat as they are pulled down. Therefore, what is now desired is a system that allows the gripping handle assembly to be pulled downwardly, but without the handles also rotating together with the pulldown arms. Instead, it would be desirable for the gripping handle assembly to be pulled straight downwardly while the pulldown arms rotate. Moreover, it would also optionally be desirable for such a handle assembly to be pivotally connected to the pulldown arms such that a user is able to move the handle assembly slightly forward or backward during the exercise (i.e.: to accommodate bending in the user's shoulders or elbows, as desired). This benefit is especially desirable because different users have different shaped arms with different shoulder and elbow locations. As will be shown, the present system provides a mechanism with a handle assembly that can be pulled downwards without also rotating as it is moved, yet can still permits some back and forth movement of the assembly (if such back and forth movement is desired, depending on the body shape of the user).

SUMMARY OF THE INVENTION

The present system provides a gripping handle assembly for a lateral pulldown exercise machine, comprising: a center mount; an outwardly extending arm connected to the center mount; an inwardly extending arm connected to the center mount, (wherein the inwardly extending arm is rotatable between a forwardly angled position and a backwardly pointing position); and a rotating swivel link connected to the center mount, wherein the swivel link is adapted to be pivotally connected to an arm of a lateral pulldown exercise machine.

In preferred embodiments, the swivel link hangs straight downwardly when suspended from the arm of the lateral pulldown exercise machine. As such, the gripping assembly (and its various handles) advantageously also remain downwardly hanging during the lateral pulldown exercise.

The present gripping handle assembly preferably provides four different gripping handle locations (or orientations) for a user to use when grabbing onto the assembly and pulling it downwardly. Specifically, an outwardly extending arm is provided for a user to use a wide-grip exercise, and an inwardly extending arm is provided for a user to have one of two narrow grips (depending upon the rotational position of the inner arms). An optional climbing mount can also be provided (for a user to grasp onto a shaped rock-like surface).

In preferred aspects, the opposite inwardly extending arms can be rotated to a forwardly angled position such that the inwardly extending arms are positioned at an angle to one another. Alternatively, the opposite inwardly extending arms can be rotated to a backward facing position where the arms are generally parallel to one another. The advantage of the backwardly angled position is that the arms are sufficiently far apart to provide clearance for a user's head therebetween (when the user is doing a pull up-style exercise).

In the present gripping handle assembly, the components are mounted to a swiveling link. This swiveling link allows the handle assembly functionality to be pivotally attached to a lateral pulldown arm on a lateral pulldown machine instead of the traditional handles currently being used on pivotal lateral pulldown arms industry wide.

A first advantage of the present gripping handle system is that it does not simply rotate together with the machine's pull down arms when the handle assembly is pulled downwardly.

A second advantage of the present gripping handle system is that it provides at least three, and optionally four, different handle orientations or objects that a user can grasp onto when pulling downwardly on the arms of a lateral pulldown machine. As such, the present gripping handle system allows the user to perform chin-up exercises, pull-up exercises, wide grip pull up exercises and a climbing hold exercise. All of these variations are incorporated into a pivotal assembly connected to a lateral pulldown arm on a lateral pulldown machine.

DETAILED DESCRIPTION OF THE DRAWINGS

Figure 1:
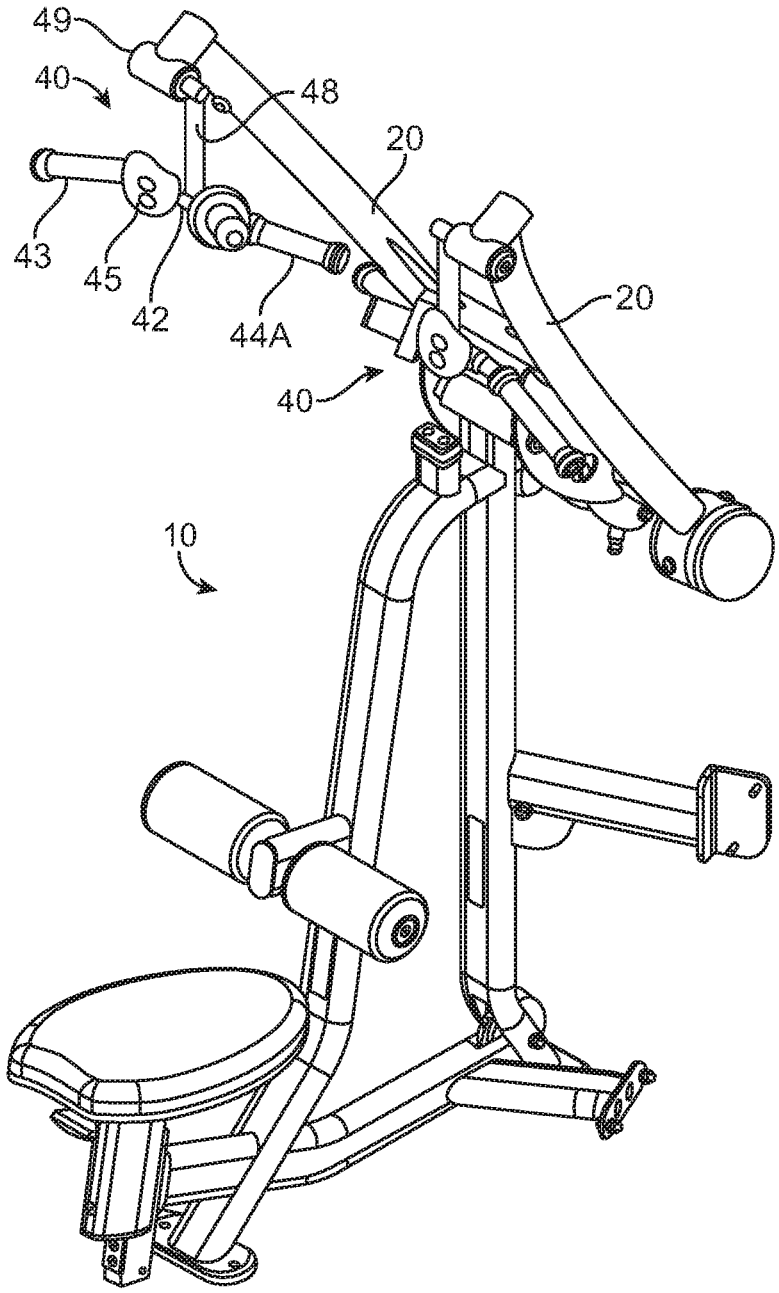
FIG. 1 is a perspective view of a lateral pulldown machine in a raised position equipped with the present Flip and Grip handle assembly (showing the inner set of handles rotated to an angled forward position).
Figure 2:
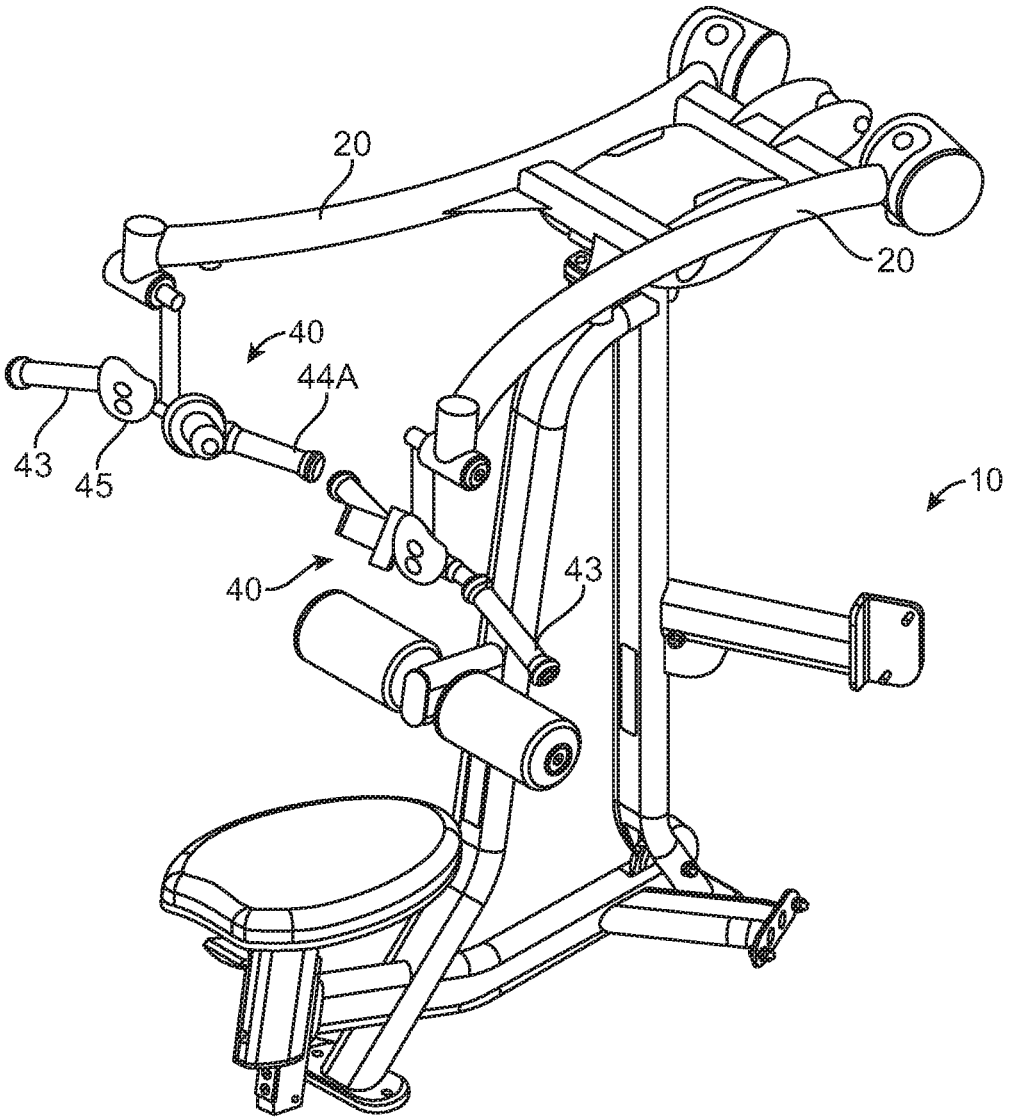
FIG. 2 corresponds to FIG. 1, but with the pull down arms lowered.

FIG. 1 shows a lateral pulldown machine 10 with its arms 20 in the raised position. The present gripping assembly 40 is attached to each of arms 20. FIG. 2 shows the position of arms 20 after a user (not shown) has been seated and pulls down on arms 20. As can be seen, there is a left-handed gripping assembly and a right-handed gripping assembly. The left and right handed gripping assemblies are therefore mirror images of one another.

Figure 3:
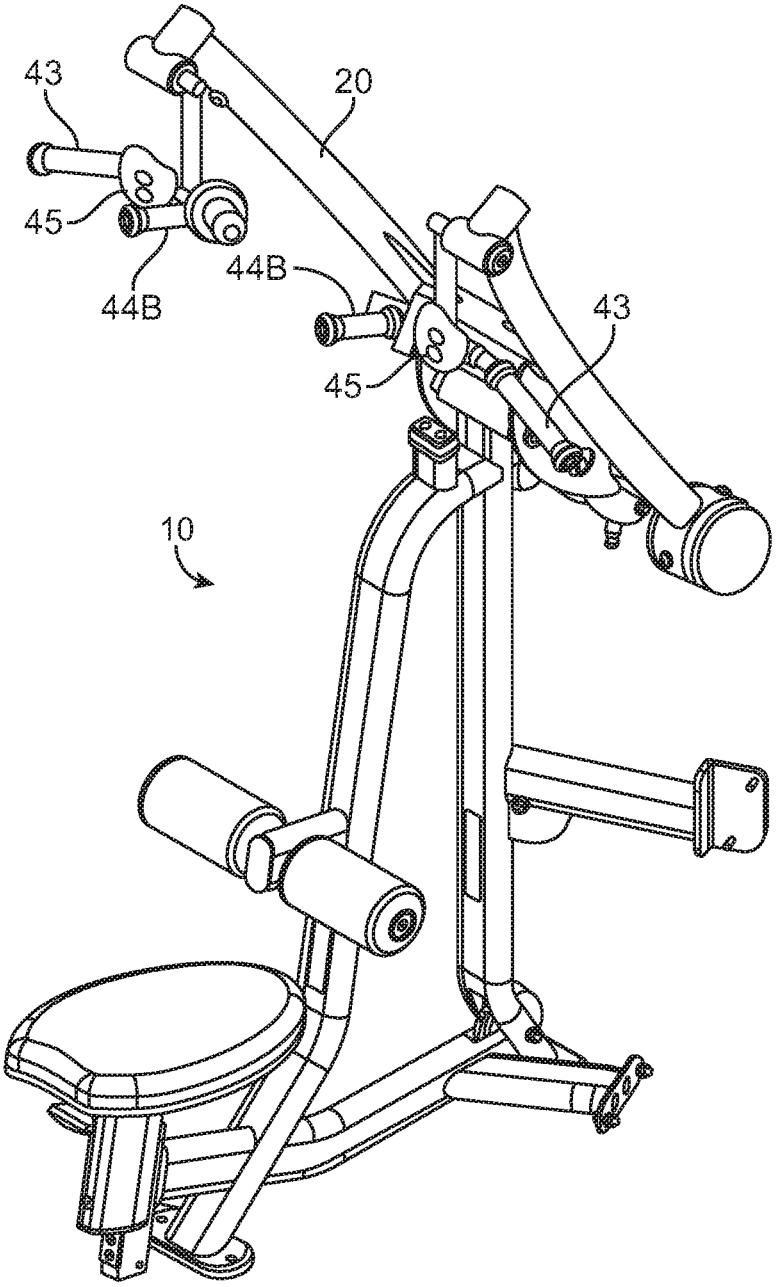
FIG. 3 corresponds to FIG. 1, but with the inner set of handles shown rotated to a position where they instead point backwardly.

As shown in more detail in the attached figures, assembly 40 comprises: a center mount 42; an outwardly extending arm 43 connected to center mount 42; and an inwardly extending arm 44 connected to the opposite side of center mount 42. Inwardly extending arm 44 is rotatable between a forwardly angled position 44A (as seen in FIGS. 1, 2, 4A and 6), and a backwardly extending position 44B (as seen in FIGS. 3, 4B, and 5).

Also included is a swivel link 48 connected to center mount 42 wherein the top end of swivel link 48 is adapted to be pivotally connected (at point 49) to an arm 20 of lateral pulldown exercise machine 10. Since swivel link 48 is pivotally connected to arm 20, assembly 40 then simply hangs straight downwardly when suspended from arm 20 of the lateral pulldown exercise machine. Importantly, as the user pulls down on assembly 40, swivel link 48 will pivot (around point 49) such that assembly 40 can hang straight downwardly, and not simply rotate together as a unit with arm 20. In addition, however, assembly 40 can be pushed somewhat back and forth (i.e. rotated somewhat around point 49) to accommodate bending movement of the user's shoulders and elbows, should a small amount of such back and forth movement be desired.

Figure 4A:
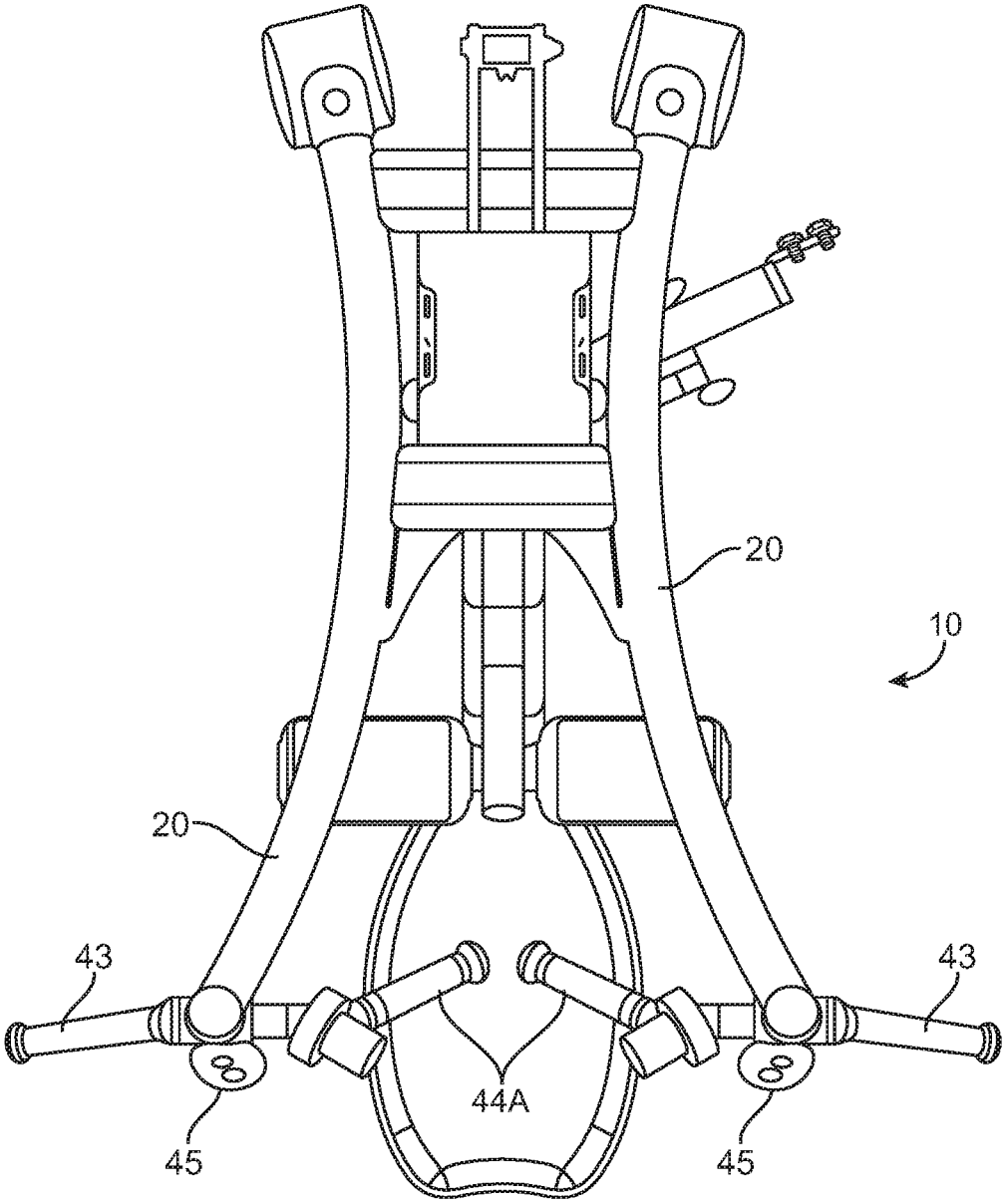
FIG. 4A is a top plan view showing the inner handles in the forwardly angled position in FIG. 1.
Figure 4B:
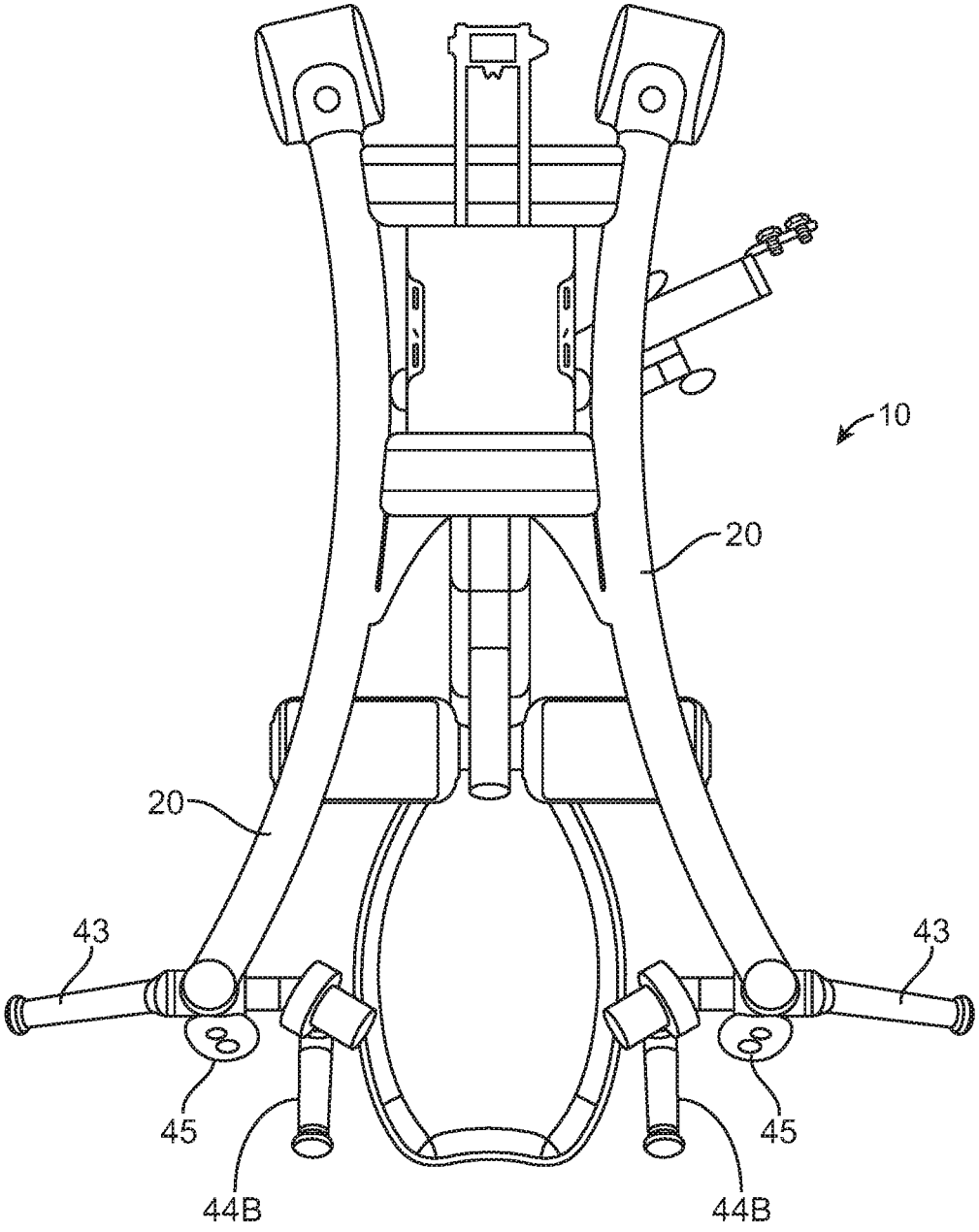
FIG. 4B is a top plan view showing the inner handles in the backwardly pointing position in FIG. 3.
Figure 5:
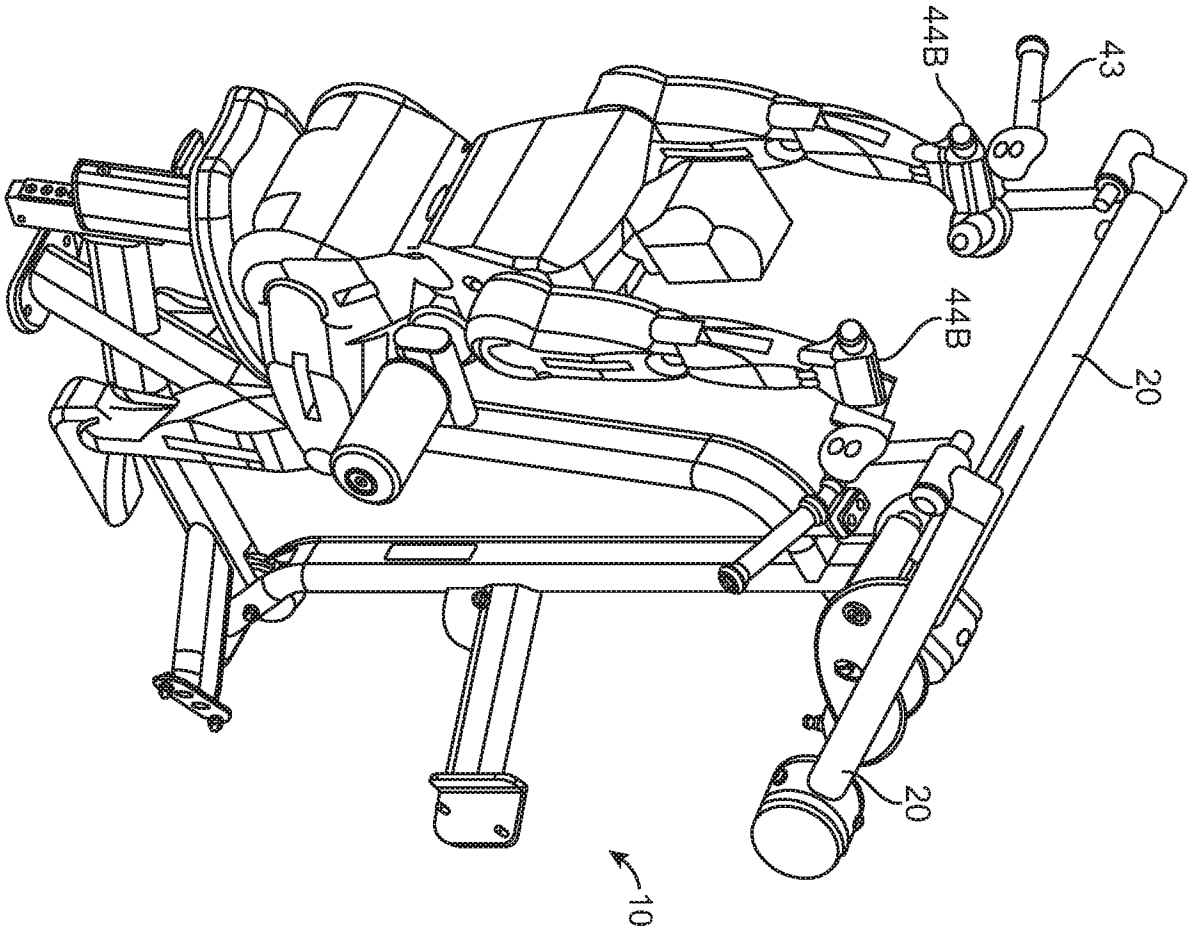
FIG. 5 shows a user grasping the inner set of handles (when the handles are in the position shown in FIG. 3.
Figure 6:
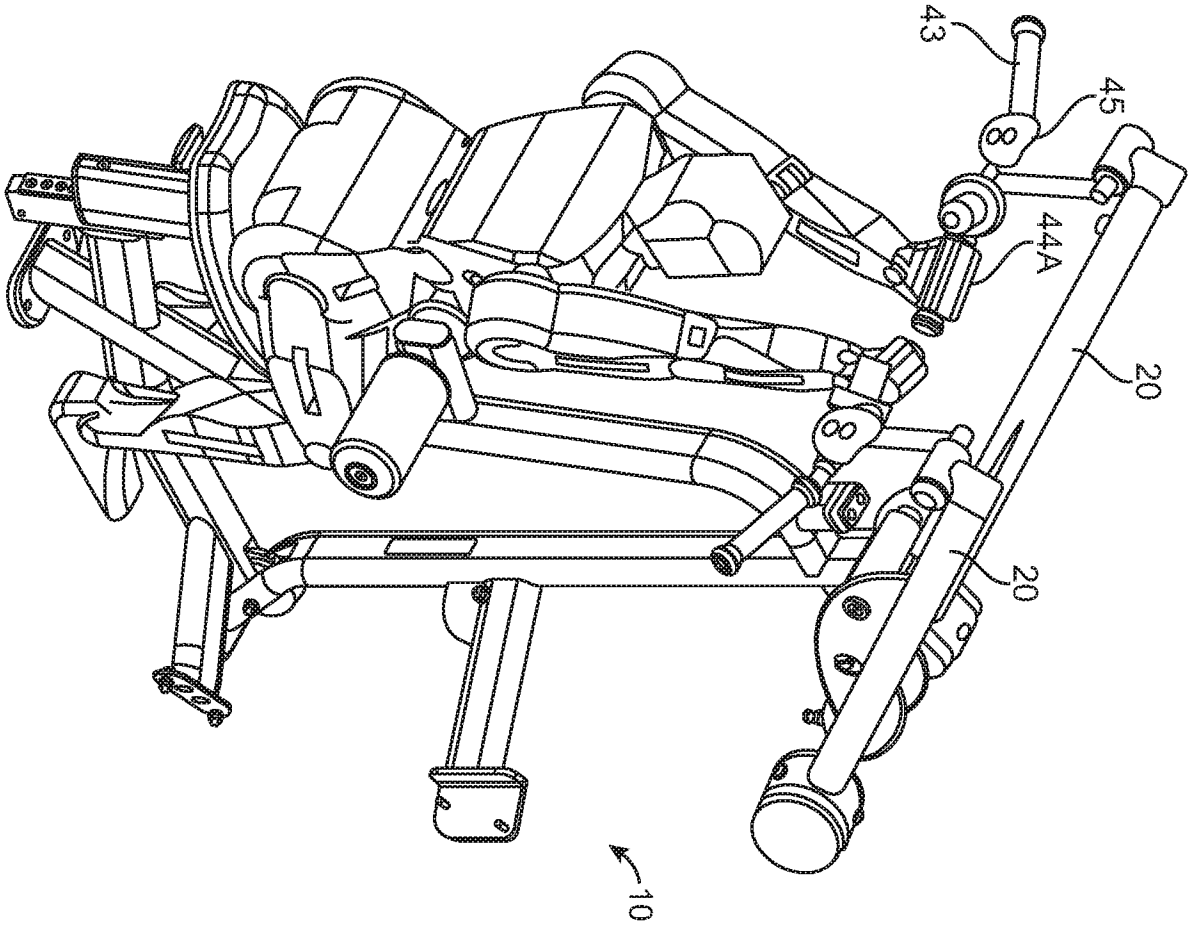
FIG. 6 shows a user grasping the inner set of handles (when the handles are in the position shown in FIGS. 1 and 2.

As seen in FIG. 4A, when inwardly extending arms are in the forwardly angled position 44A, then the inwardly extending arms are positioned at an angle to one another. Conversely, as seen in FIG. 4B, when inwardly extending arms are in the backwardly angled position 44Bm then the opposite inwardly extending arms are generally parallel to one another. The advantage of the arm position shown in FIG. 4B is that arms in position 44B are sufficiently far enough apart to provide clearance for a user's head there between (thus allowing the user to pull farther downwardly on rotating arms 20).

Figure 7:
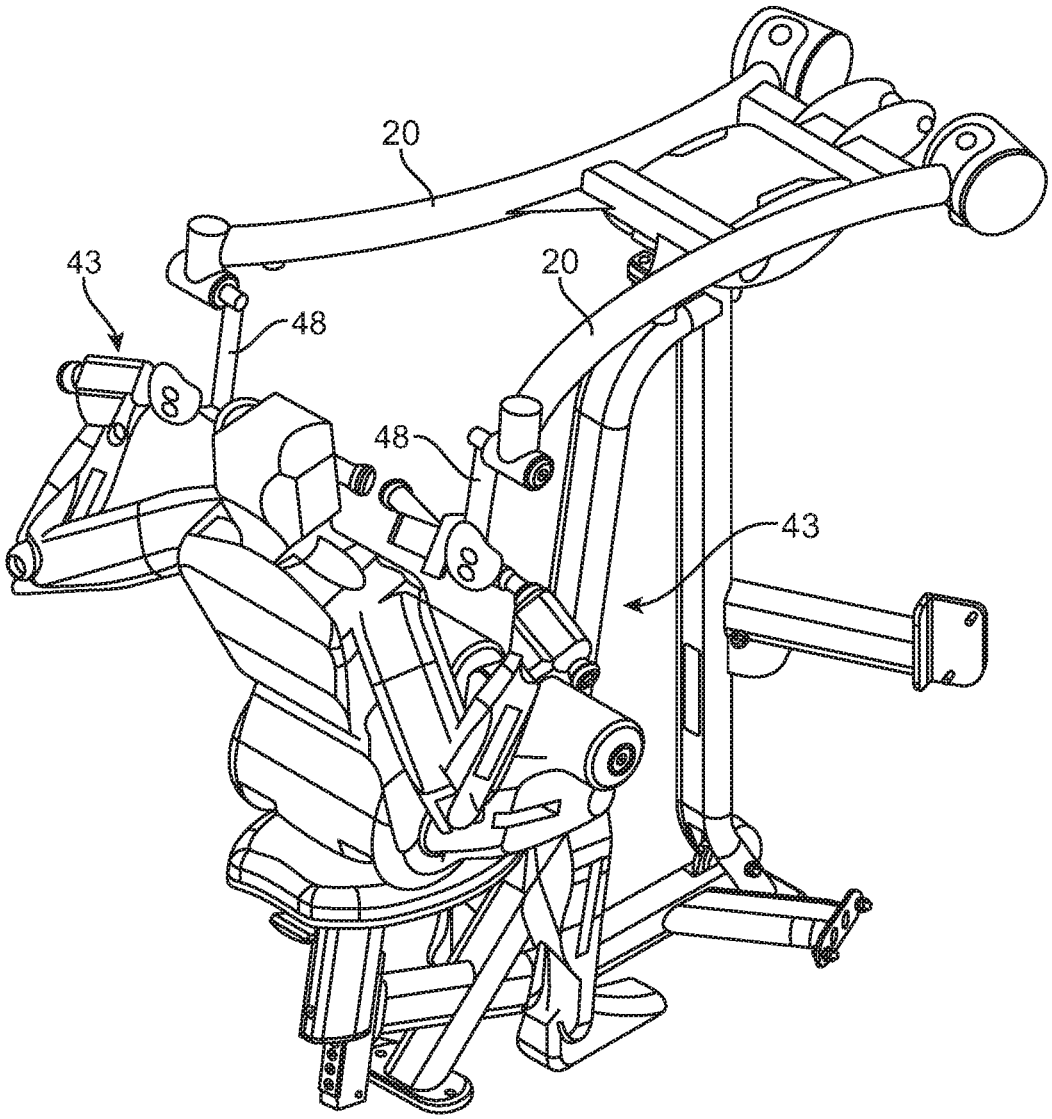
FIG. 7 shows a user grasping the outwardly extending set of handles.

In summary, the user of the present system advantageously has many different options when holding onto the gripping handles of assembly 40. For example, the user can hold the outwardly extending handles 43 for a wide-grip pull down (FIG. 7). Alternatively, the user can hold the inwardly extending handles 44 in their forwardly rotated position 44A (FIG. 6) or in their rearwardly rotated position 44B (FIG. 5). Alternatively, the user may instead simply grab onto climbing mounts 45 (to pull down on a textured rock-type surface).

When using a lateral pulldown machine with the present pivotal lateral pulldown arm assembly, the user stands and grips one of the exercise handles incorporated in the present assembly 40. Next, the user sits down with his/her legs under some type of stabilizing pad for support. The user then performs the exercise by pulling the handles down to chin level and repeating. Advantageously, the present system provides gripping pull down handles permitting a user to perform wide grip pulls ups (using outwardly extending handles 43 or inwardly extending handles in position 44B), or more narrow grip chin ups (using inwardly extending handles in position 44A).

Figure 8A:
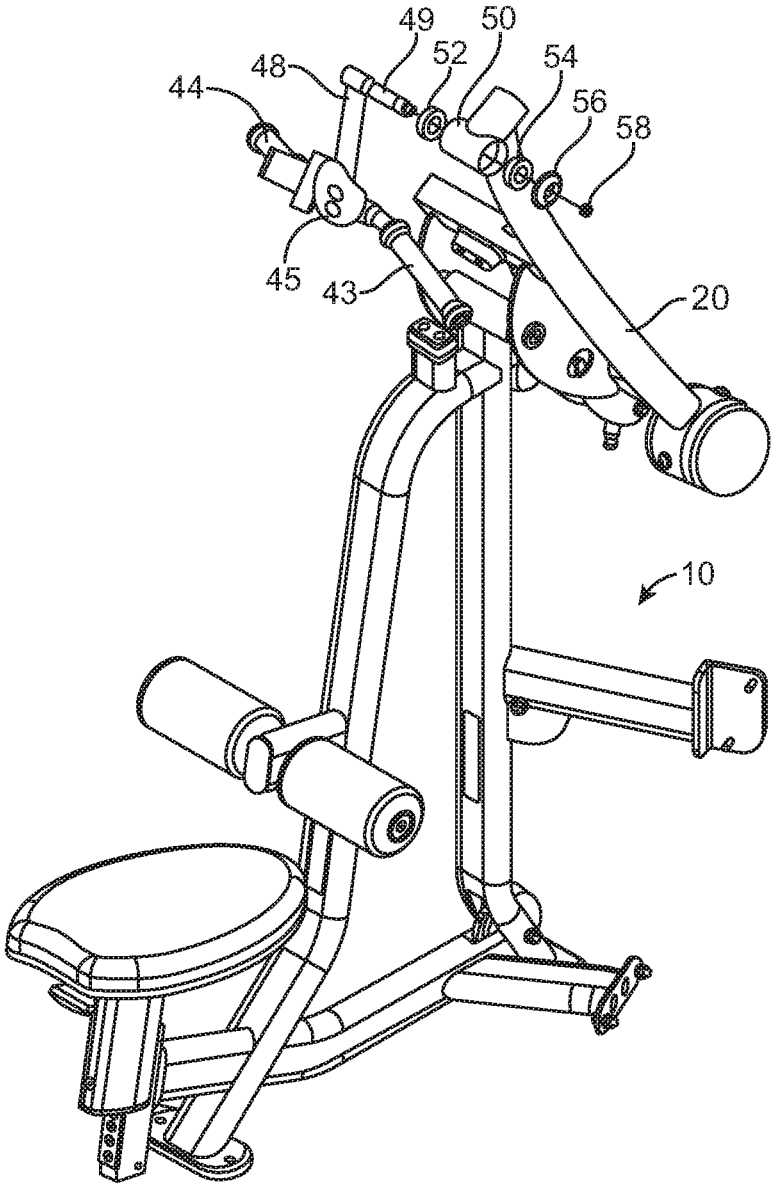
FIG. 8A is an exploded view of the mounting system for the present gripping handle assembly, showing its mounting onto an arm of the Lateral Pulldown machine.
Figure 8B:
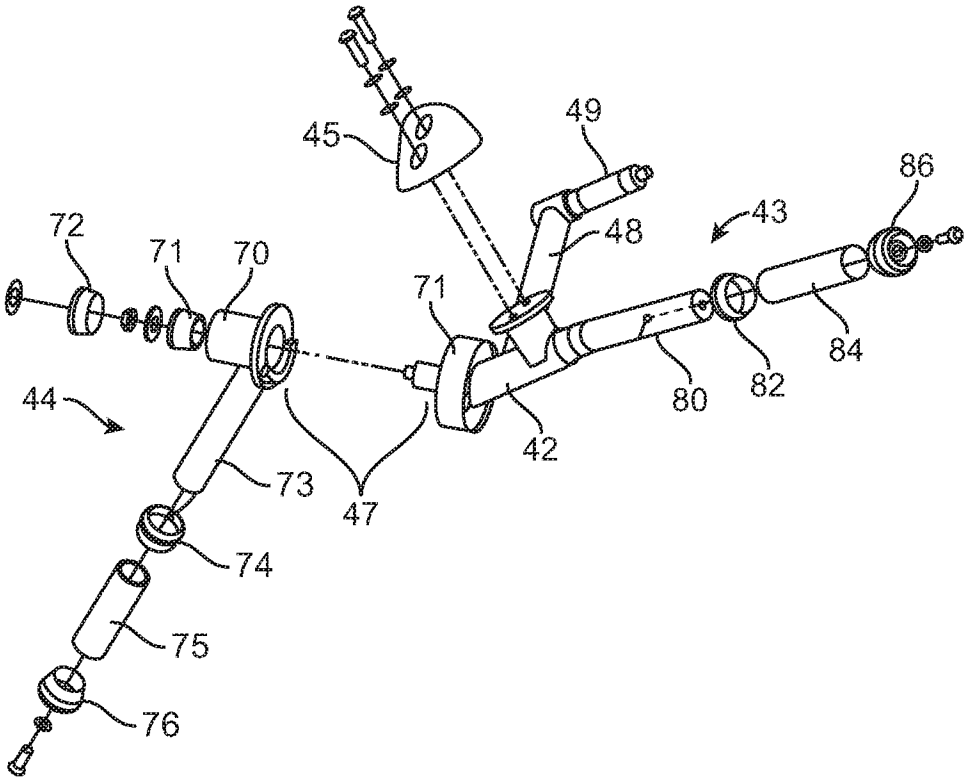
FIG. 8B is an exploded view of the present gripping handle assembly.

FIGS. 8A and 8B are exploded views that show additional details of the pivoting connection at point 49. These exploded views that shows additional components of assembly 40, including housing 50, bearings 52 and 54, end cap 56 and nut 58. In preferred aspects, the two-part rotational mount assembly 47 permits inwardly extending handle 44 to rotate by 90 degrees (such that handles 44 are positioned parallel to the ground in either of positions 44A or 44B). Handle 44 can extend from a housing 70 (which is connected to housing 71 by bushing 71, washers and end cap 72). Similarly, handle 43 can extend from center mount 42. Handle 44 can be formed from a handle 73, finishing ring 74, hand grip 75 and end cap 76. Similarly, handle 43 can be formed from a handle 80, finishing ring 82, hand grip 84 and end cap 86.

What is claimed is:

1. A lateral pulldown machine assembly, comprising:

a lateral pulldown machine having a pivoting lateral pulldown arm; and a pair of gripping assemblies connected to the pivoting lateral pulldown arm, each gripping assembly comprising:

a center mount;

an outwardly extending arm connected to the center mount;

an inwardly extending arm connected to the center mount, the inwardly extending arm having a gripping handle, wherein the center mount comprises a two part rotational mount assembly connected to the inwardly extending arm such that the inwardly extending arm is rotatable between a forwardly angled position at which the gripping handle points towards the lateral pulldown exercise machine and a backwardly pointing position at which the gripping handle points away from the lateral pulldown exercise machine, and wherein the two part rotational mount assembly permits the gripping handle to rotate such that the gripping handle is parallel to the ground in either of the forwardly angled position or the backwardly pointing position; and a swivel link connected to the center mount, wherein the swivel link is pivotally connected to the pivoting lateral pulldown arm of the lateral pulldown exercise machine, and wherein the gripping handle is parallel to the ground while the lateral pulldown arm pivots, wherein the swivel link hangs straight downwardly when suspended from the pivoting lateral pulldown arm of the lateral pulldown exercise machine.

2. The lateral pulldown machine assembly of claim 1, further comprising:

a climbing mount attached to the center mount.

3. The lateral pulldown machine assembly of claim 1, wherein the forwardly angled position of each gripping handle of the respective inwardly extending arm of the pair of gripping assemblies is positioned at an angle to one another.

4. The lateral pulldown machine assembly of claim 1, wherein the backwardly pointing position of each gripping handle of the respective inwardly extending arm of the pair of gripping assemblies is positioned generally parallel relative to one another.

5. The lateral pulldown machine assembly of claim 4, wherein the backwardly pointing positions of the gripping handles of the respective inwardly extending arms are sufficiently far enough apart to provide clearance for a user's head therebetween.

* * * * *